United States Patent [19]

Costa

[11] Patent Number: 4,691,369

[45] Date of Patent: Sep. 1, 1987

[54] BAG WITH HANDLE AND METHOD OF MAKING THE SAME

[75] Inventor: Robert E. Costa, Middletown, N.Y.

[73] Assignee: Champion International Corporation, Stamford, Conn.

[21] Appl. No.: 896,233

[22] Filed: Aug. 14, 1986

[51] Int. Cl.[4] ..... B65D 33/06

[52] U.S. Cl. ..... 383/17; 383/8; 383/29; 383/20; 229/52 AC

[58] Field of Search ..... 383/17, 6, 8, 20, 21, 383/29; 220/94 R; 229/52 AC, 52 AL

[56] References Cited

U.S. PATENT DOCUMENTS

| | | | |
|---|---|---|---|
| 1,154,043 | 9/1915 | Morton | 229/52 AC |
| 2,325,853 | 8/1943 | Harlem | 383/6 |
| 2,980,312 | 4/1961 | Gould | 383/20 |
| 2,987,239 | 6/1961 | Atwood | 229/52 AC |
| 2,992,768 | 7/1961 | Gatward | 229/52 AC |
| 3,105,628 | 10/1963 | Mack | 383/20 |
| 3,208,492 | 9/1965 | Braithwaite | 383/20 |
| 3,373,925 | 3/1968 | Gatward | 383/20 |
| 3,456,865 | 7/1969 | Frank | 229/52 AC |

*Primary Examiner*—Willis Little

*Attorney, Agent, or Firm*—Evelyn M. Sommer

[57] ABSTRACT

The bag is preferably a flat bottom side gusseted open top bag of the shopping bag type, which has soft braided or woven fabric handles. The handles are closed bail type handles having ends which are sandwiched between the bag side walls and a patch adhesively secured to the inner surface of the bag side walls. The bail portion of each handle is soft, limp and flexible while the end portions of each handle sandwiched between the patch and bag wall are stiff and relatively rigid. The ends of the handles are stiffened prior to assembling the bags. In assembly, the bag body is formed and the patches are adhesively secured to the bag side walls. Non-adhered pockets are positioned between the patches and the bag walls for reception of the stiffened ends of the handles. The ends of the handles are coated with adhesive and then inserted into pockets for securing to the bag body.

6 Claims, 5 Drawing Figures

BAG WITH HANDLE AND METHOD OF MAKING THE SAME

This invention relates to bags with bail type handles and more particularly to an improved bag which has soft, limp and flexible braided or woven handles.

Open top shopping bags are conventionally made with bail handles which may be an integral part of the bag or may be a separate component secured to the bag. The handles, when a separate component of the bag, may be adhesively secured to the bag, stapled to the bag, knotted to the bag, or the like. The handles per se may be twisted paper, molded plastic, braided or woven fabric, or the like.

This invention relates to bags having separate handles which are formed from braided or woven fabric and which are adhesively secured to the bags. The bags are typically formed from paper, coated paper, plastic, or the like. Bags of this type having braided or woven fabric handles are known in the prior art. The braided or woven fabric handles are quite soft, limp and flexible and are attached to the bags in one of two ways. The bags will be provided with paper patches adhesively secured to the inner surface of opposed walls of the bag. In one form, the patches will be provided with openings through which the inner ends of the handles are threaded. After threading, the ends of the handles are knotted so that they cannot be pulled back through the openings in the patches, thus securing the handles to the bags. In the other form, small rigid disks are secured to the ends of the handles and the disked ends are sandwiched between the patch and bag wall and adhesively secured in place when the patches are adhered to the bag wall. These types of bags with the soft braided or woven fabric handles are very popular due to their comfort for gripping, but are expensive because they must be hand assembled due to the softness and flexibility of the handles. Stiffer handles, such as molded plastic or twisted paper, are less expensive because they can be automatically assembled. These stiffer types of handles can have their ends automatically pushed in between the patches and bag walls after the patches have been secured to the bag walls. The ends of these stiffer handles will be coated with adhesive which will secure the handles in place between the patches and the bag walls.

In accordance with this invention, the ends of the soft braided or woven fabric handles are modified to stiffen them so that they can be pushed into adhesive-free pockets between the patches and bag walls after being coated with adhesive. Only the ends of the handles are stiffened so that the hand gripping central portion of the bail retains its soft, comfortable nature. The stiffening can be accomplished in several different ways. If the handles are made from braided or woven polymeric material, such as polypropylene or the like, the ends of the handles can be momentarily confined in a heated die to fuse the polymeric fibers into a hardened condition. If the handles are formed from a polymeric material or from a natural fibrous material, the ends can be fitted with appropriately sized sleeves of acetate, or the like, much like the ends of a shoe lace are stiffened. Alternatively, the ends of the handle can be impregnated with any material which, upon drying, will harden.

These modified handles can be prepared separately in assembly line fashion while the bag bodies are likewise prepared separately in assembly line fashion, as follows.

The bags are cut, folded and glued to their normal form. On the inside surfaces of opposed side walls of each bag, paper patches are preferably adhesively secured in place. The adhesive pattern, securing the patches to the bag is such that a pocket is provided between each patch and the adjacent side wall, while pocket is adhesive-free. This pocket opens toward the mouth of the bag so that the stiffened ends of the handles can be pushed into the pocket so as to lie between the patch and the bag side wall. The resultant bag has a strong and durable handle connection and yet retains the soft, comfortable gripping portion of the handle. Manufacturing costs using this invention are approximately one-third the costs involved using the prior art procedures for forming these soft handled bags which require assembly by hand.

It is therefore an object of this invention to provide an improved soft handle paper bag and a method of forming the same.

It is a further object of this invention to provide a bag of the character described wherein the handles are soft braided or woven fabric bail handles having stiffened ends for securement to the bag body.

It is another object of this invention to provide a bag of the character described wherein the stiffened ends of the handles are pushed into reception pockets in the bag side walls for adhesive securement therein.

It is yet another object of this invention to provide a bag of the character described which can be made more efficiently and at a lesser manufacturing cost.

These and other objects and advantages of the invention will become more readily apparent from the following detailed description of preferred embodiments of the invention when taken in conjunction with the accompanying drawings, in which.

Figure 1:
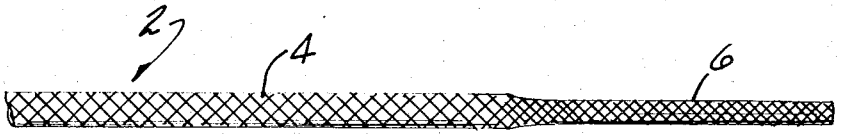
FIG. 1 is a fragmented side elevational view of one embodiment of a handle formed in accordance with this invention.
Figure 2:
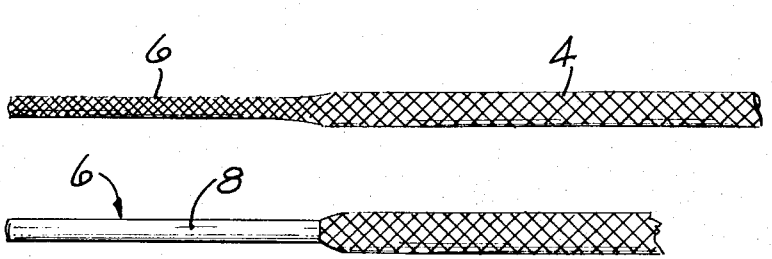
FIG. 2 is a fragmented side elevational view of one end of a second embodiment of a handle formed in accordance with this invention.
Figure 3:
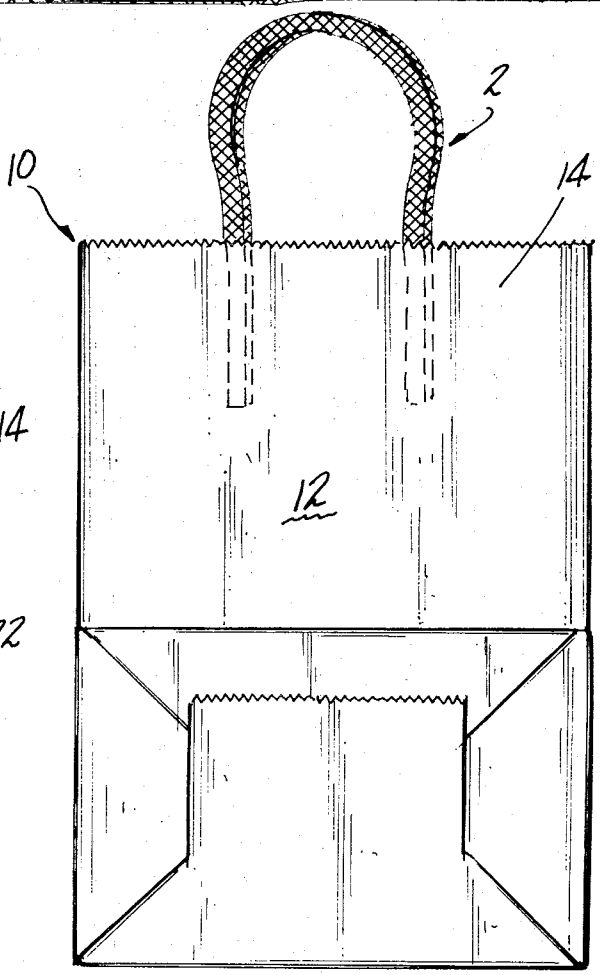
FIG. 3 is a side elevational view of a bag provided with handles formed in accordance with this invention.

Referring now to the drawings, there is shown in FIG. 1 one embodiment of a bag handle formed in accordance with this invention. The handle, denoted generally by the numeral 2, is formed from a woven or braided fabric material and includes a central hand grip portion 4 and end securement portions 6. The handle shown in FIG. 1 is formed from a braided polymeric fiber such as polypropylene, and the end securement portions 6 are formed by momentary confinement in a heated die sufficient to fuse the fibers whereby fiber stiffening takes place. The end securement portions 6 are thus considerably stiffer than the central hand grip portion 4, the latter of which retains its natural soft and flexible nature. In the embodiment of FIG. 2, the stiffened end securement portion 6 is formed by a sleeve 8 of material such as acetate which encircles and constricts the ends of the handle 2. The assembled bag 10 is shown in FIG. 3. The handles 2 are secured to the bag body 12 by being adhesively fixed to the side walls 14 of the bag body 12.

Figure 4:
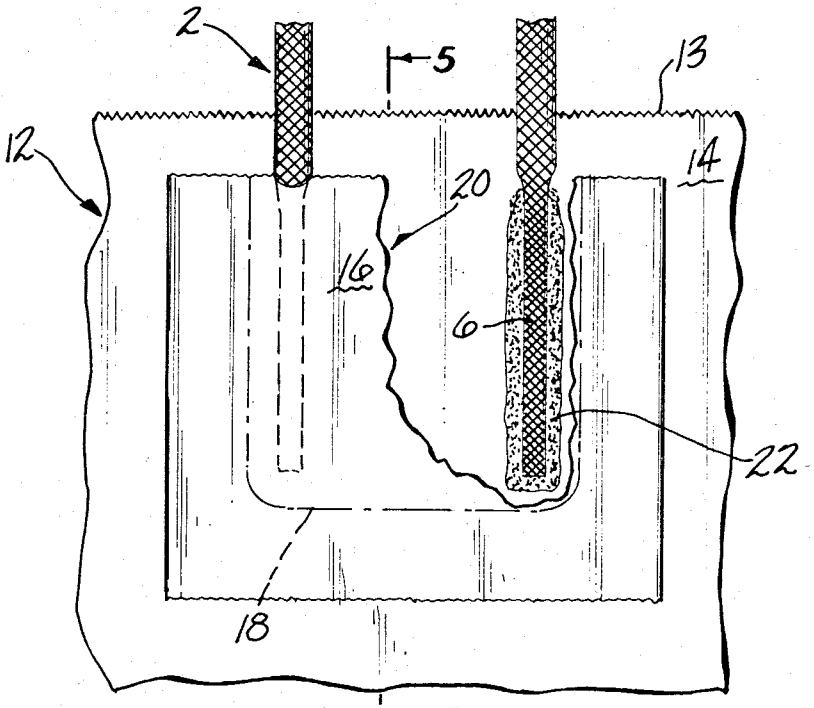
FIG. 4 is a fragmented elevational view of the inside surface of one of the walls of the bag of FIG. 3 showing the patch adhesively secured thereto and partially cut away to show how the ends of the handle are disposed with respect to the patch and bag.
Figure 5:
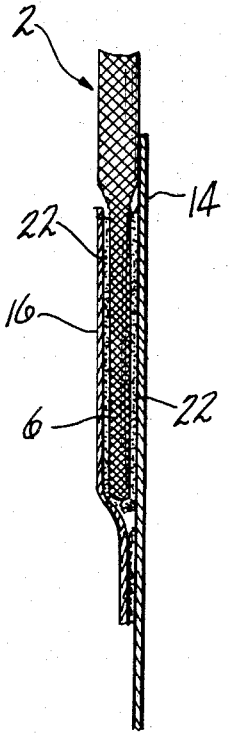
FIG. 5 is a fragmented sectional view taken along line 5—5 of FIG. 4.

The manner of securement of the handles 2 to the bag body 12 is more clearly shown in FIGS. 4 and 5. A paper patch 16 is secured to the inside surface of the bag side wall 14 along three edges by a U-shaped strip of adhesive which lies generally outwardly of the phantom line 8. This leaves a central pocket 20 between the patch 16 and side wall 14 which is devoid of adhesive and which is open toward the upper edge 13 of the bag body 12. Prior to assembly, the ends 6 of the handle 2 are coated with adhesive 22 and then inserted into the pocket 20, as shown in FIG. 4. As shown in FIG. 5, the adhesive 22 secures the securement ends 6 of the handle 2 to the patch 16 and to the bag wall 14, providing a very solid, non-failing joinder of the handle and bag body.

It will be appreciated that the stiffened ends of the handles allow the latter to be manipulated by automated machinery, will allow dipping of the handle ends into a glue reservoir, and will allow the ends of the handles to be pushed into place in the bag pockets on an automated assembly line, or at least will allow much faster manual assembly of the bags on an assembly line.

Since many changes and variations of the disclosed embodiments of the invention may be made without departing from the inventive concept, it is not intended to limit the invention otherwise than as required by the appended claims.

What is claimed is:

1. An elongated handle for a bag, said handle being formed from a braided or woven fabric material and said handle having a soft, limp and flexible central hand gripping portion and stiffened end portions for securement to the bag, wherein said stiffened end portions are formed by sleeves encircling said handle at said end portions thereof.

2. The handle of claim 1 wherein said sleeves are formed from acetate.

3. The handle of claim 1, wherein said fabric material is a polymeric fiber.

4. The handle of claim 3 wherein said polymeric fiber is polypropylene.

5. A bag comprising an open top paper body portion and at least one handle, said body portion including at least one paper patch adhesively secured thereto adjacent the open top thereof, said patch forming an open top pocket with an adjacent inner side wall of said body portion of the bag, and said handle being formed from a braided or woven fabric material and having a medial soft, limp and flexible hand gripping bight portion and stiffened end portions, said stiffened end portions being formed by sleeves encircling said handle at said end portions thereof and being disposed in said pocket between said patch and the adjacent bag side wall, said stiffened end portions being adhesively secured to said patch and said bag side wall, said bight portion of the handle extending above the open top of the bag body portion

6. A method of forming a paper bag, said method comprising the steps of:

(a) providing an open top paper bag body;

(b) providing at least one paper patch;

(c) securing said paper patch to an inside surface of a wall of said paper bag body adjacent the open top thereof, said patch being secured to said wall along three edges of said patch with a remaining edge of said patch being free of securement to said wall to form an open top pocket between said patch and said wall;

(d) providing at least one handle formed from a braided or woven fabric material and having a soft, limp and flexible medial hand gripping portion and opposed stiffened end portions, wherein said stiffened end portions are formed by sleeves encircling said handle at said end portions thereof; and (e) inserting the stiffened end portions of said handle into said open top pocket between said patch and bag body wall with said hand gripping portion of said handle extending above the open top of the bag body whereby said handle is secured to the bag body.

* * * * *